United States Patent [19]

Farag et al.

[11] Patent Number: 4,728,758

[45] Date of Patent: Mar. 1, 1988

[54] LOAD BREAK SWITCH AND INTERLOCK ASSEMBLY

[75] Inventors: Samir F. Farag; John D. Kleinecke; Thomas R. Little, all of Wichita Falls, Tex.

[73] Assignee: Siemens Energy & Automation, Atlanta, Ga.

[21] Appl. No.: 4,372

[22] Filed: Jan. 15, 1987

[51] Int. Cl.[4] ..... H01H 9/22

[52] U.S. Cl. ..... 200/50 A

[58] Field of Search ..... 200/50 A; 361/335-345

[56] References Cited

U.S. PATENT DOCUMENTS

| | | | |
|---|---|---|---|
| 2,574,745 | 11/1951 | Langley | 200/50 A |
| 2,786,908 | 3/1957 | Constantine et al. | 200/50 A |
| 3,179,762 | 4/1965 | Swinney | 200/50 A |
| 3,354,352 | 11/1967 | Goodridge | 200/50 A |
| 4,419,549 | 12/1983 | Osborne | 200/50 A |

*Primary Examiner*—J. R. Scott

*Attorney, Agent, or Firm*—James G. Morrow; Volker R. Ulbrich

[57] ABSTRACT

A load break switch and interlock assembly is housed in a cabinet with a door. The switch assembly is oriented 90° from a normal position along the backwall of the cabinet and is located on a sidewall. The switch handle protrudes through the front of the cabinet. The handle is horizontally oriented to interfere with the door when the switch is closed thereby preventing the door from being opened. When the switch is open, the handle is vertically oriented and does not interfere with the door.

2 Claims, 2 Drawing Figures

LOAD BREAK SWITCH AND INTERLOCK ASSEMBLY

BACKGROUND OF THE INVENTION

This invention relates to a load break switch assembly and more particularly to a load break switch and enclosure wherein the switch handle acts as an interlock for the enclosure door.

As its name implies, a load break switch functions to open a circuit when current is flowing. There are many uses for load break switches for controlling various types of electrical equipment. In some environments, it is desirable to enclose the load break switch in an enclosure or cabinet to prevent access by unauthorized persons as well as protect components from the atmosphere. It is easily seen that merely placing a load break switch in a cabinet will not prevent access by unauthorized persons. It is possible to use a padlock or other type of lock to securely lock the cabinet door to limit access only to those persons having the combination or a key. While this method works, it is not practical because people must remember the combination or many keys have to be made. It will be appreciated that it would be highly desirable to have an enclosure for a load break switch which limits access without using cumbersome locks and keys.

In some types of electrical apparatus, it is common to use interlock mechanisms which cooperate with the door to the enclosure so that the door cannot be opened when the circuit is closed. This is a practical solution; however, some interlock mechanisms can be expensive to manufacture and fairly complicated. It is desirable to have a simple mechanism which is easy to manufacture and use.

Another problem with placing load break switch mechanisms inside cabinets is that the interior of the cabinets tend to be cluttered and rather unsightly. The interior of the cabinet will contain bus bars for carrying current to and from the load as well as numerous insulators and spacers to insulate the bus bar from the metal components of the cabinet. Similarly, the components of the load break switch are usually bulky and cumbersome and require numerous insulators to insulate them from the metal components of the cabinet. Typically, the load break switches are three-phase or three-pole mechanisms which have a longitudinal axis which is oriented horizontally in the cabinet. With the switch assembly oriented in this fashion, the bus bars are conveniently run along the back wall of the cabinet. One difficulty with this arrangement is that with this horizontal orientation of the switch assembly, the operating handle protrudes from the left or right sidewall of the cabinet. This limits what can be placed next to a particular load break switch cabinet. Accordingly, it can be appreciated that it would be highly desirable to provide a load break switch assembly which does not have a handle protruding from the sidewalls of the enclosure.

As mentioned above, typical interlock mechanisms are constructed so that they work in conjunction with the operating handle or the door. One type of load break switch which has the interlock mechanism associated with the handle uses a complicated chain drive which reacts to movement of the handle to open the load break switch in response to the handle movement. Because this mechanism contains chains and numerous parts, it is expensive to manufacture, bulky and requires a certain amount of space in the enclosure. It can be appreciated, that it would be highly desirable to provide a simple interlock mechanism which uses a minimal amount of space on the interior of the cabinet and does not require the use of chains.

Accordingly, it is an object of the present invention to provide a load break switch assembly which can be mounted in an enclosure.

Another object of the present invention is to provide a load break switch assembly which is mounted in an enclosure which can be placed side-by-side with other enclosures.

Another object of the invention is to provide a load break switch and enclosure which uses the operating handle as an interlock.

SUMMARY OF THE INVENTION

Briefly stated, in accordance with one aspect of the invention, a load break switch and interlock assembly includes a cabinet, a switch assembly and an operating handle. The cabinet has a rear wall with bus bars attached thereto, sidewalls, and a front wall which has a jamb receiving a door and defining a front wall opening. The door opens outwardly away from the cabinet. The switch assembly has a longitudinal axis and is connected to one of the sidewalls with the longitudinal axis oriented generally parallel to the sidewall and perpendicular to the rear wall and front wall. The switch assembly is operable between an open and a closed position. The operating handle extends through the front wall opening operatively engaging the switch assembly. The operating handle interferes with the opening of the door when the switch is on and is free of interference with the door when the switch is off.

BRIEF DESCRIPTION OF THE DRAWINGS

While the specification concludes with claims particularly pointing out and distinctly claiming the subject matter which is regarded as the invention, it is believed that the invention would be better understood from the following description of the preferred embodiment taken in conjunction with the accompanying drawings in which:

DESCRIPTION OF THE PREFERRED EMBODIMENT

Figure 1:
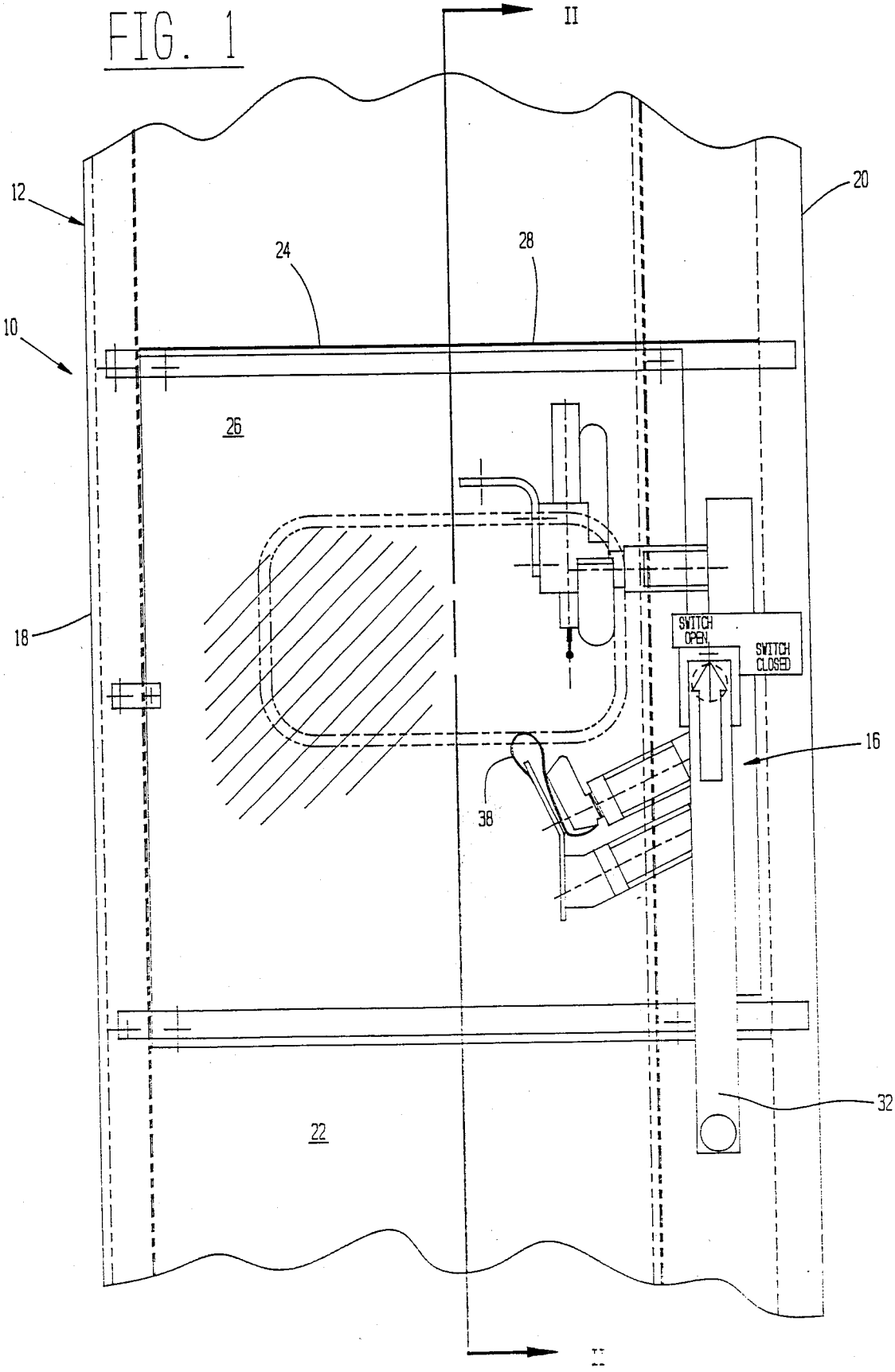
FIG. 1 is a diagrammatic front view of an enclosure containing a load break switch assembly.
Figure 2:
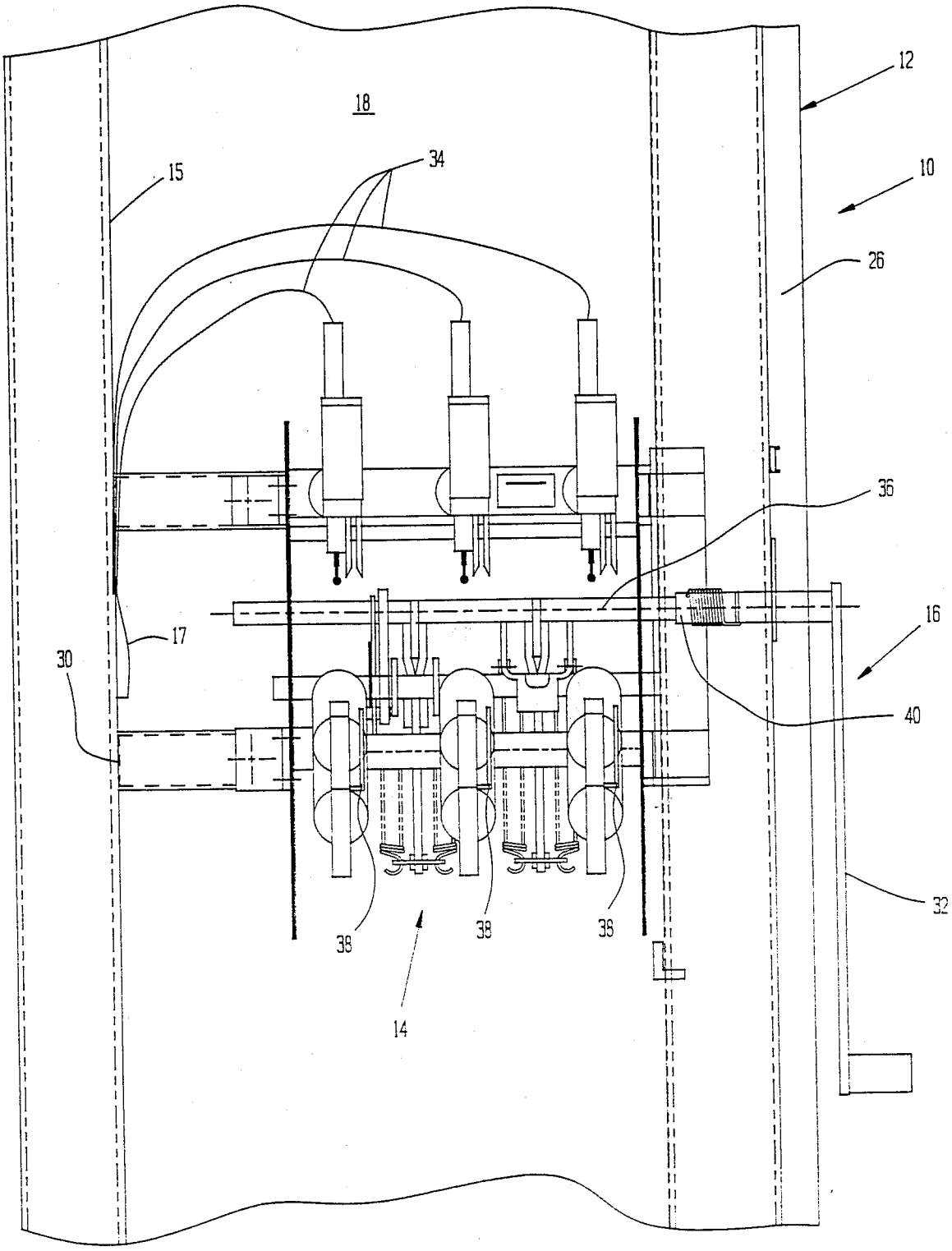
FIG. 2 is a diagrammatic longitudinal sectional view taken along line II—II of FIG. 1.

Referring to FIGS. 1 and 2, a load break switch and interlock assembly 10 includes a cabinet 12, a switch assembly 14 and an operating handle 16. The cabinet 12 has a rear wall 15 with bus bars 17 attached thereto. In the preferred embodiment illustrated, the bus bars 17 extend vertically along the rear wall 15. The cabinet 12 also contains left and right sidewalls 18, 20 and a front wall 22. The front wall has a jamb 24 receiving a door glass 26 and defining a front wall opening 28. The door 26 opens outwardly away from the cabinet 12 to expose the switch assembly 14 on the interior of the cabinet. Depending upon the intended use, the cabinet 12 may be constructed of a rigid framework with sheetmetal members connected thereto as by bolts or screws, for example. Alternatively, the cabinet can be constructed from sheetmetal components properly connected with bolts and nuts or welded together. The cabinet 12 can be constructed from sheetmetal members that have the edges or end portions formed into angles, or L-shaped channels for connecting to one another as is known in the art.

The switch assembly is located inside the cabinet and is connected to one of the sidewalls 18, 20. As shown in FIG. 2, the switch assembly is connected to the right sidewall 20. The switch assembly 14 may be directly connected to the sidewall if properly insulated therefrom or it may be connected to structural members or braces anchored to the framework of the cabinet. The particular method of construction is best judged by the particular operating environment of the enclosure. The switch assembly 14 has a longitudinal axis 30 and is connected to the sidewall 20 with the longitudinal axis 30 oriented generally parallel to the sidewall 20 and generally perpendicular to the rear wall 26 and front wall 22. As illustrated in FIG. 2, the switch assembly also includes a control shaft 36 for controlling the position of the switch contacts 38. The control shaft 36 has an axis of rotation which is parallel to the longitudinal axis 30 of the switch assembly 14. The control shaft 36 is also parallel with the side walls 18, 20. Because the switch assembly 14 is connected to the sidewall, jumpers 34 are used to connect the switch assembly to the bus bars 17. The switch assembly 14 is operable between an open position and a closed position.

The operating handle 16 extends through the front wall opening 28 and operatively engages the switch assembly 14. The operating handle 16 includes an elongate member 32 which is preferably oriented vertically when the switch assembly 14 is open. As illustrated in FIG. 2, the mounting collar 40 of the elongate member 32 is fixed to the control shaft 36. The control shaft 36 is rotatively mounted such that the elongate member 32 can move from a vertical to a horizontal direction. In this vertical position, the handle does not interfere with operation of the door 26 so that the door 26 is free to be opened exposing the interior of the cabinet. On the other hand, when the switch assembly 14 is closed, the operating handle moves to a horizontal orientation such that it is positioned over the door interfering with the opening of the door. In this manner, the door cannot be opened while the switch is closed.

Operation of the load break switch and interlock assembly is believed to be apparent from the foregoing description; however, a few words about the operation will be made for amplification. The purpose of a load break switch is to open a circuit to a load while current is flowing. The operating handle is used to operate the switch assembly to accomplish the opening and closing of the switch assembly. When the switch assembly is open, the handle is vertically oriented and is free of interference with the door. Thus, when the switch is open, the door can be freely opened exposing the interior of the cabinet. On the other hand, when the handle is moved to close the switch, the handle moves from a vertical orientation to a horizontal orientation and blocks the opening of the door. Thus, when the switch is closed, the handle interferes with the door preventing the door from being opened to expose the interior of the cabinet while the switch is closed and current is flowing.

It will now be understood that there has been represented a load break switch and interlock assembly which is simple to operate and does not require the use of chains or an extraordinary large number of components. The interlock mechanism is simple being formed as a part of the handle assembly to allow the door to open when the switch is open and to prevent the door from opening when the switch is closed. Also, the handle is mounted on the front of the cabinet and there are no parts protruding from the sidewalls of the enclosure. Therefore, the enclosure can be stacked side-by-side with other units saving space and making for a neater appearance.

As will be evident from the foregoing description, certain aspects of the invention are not limited to the particular details of the examples illustrated and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A load break switch and interlock assembly, comprising:

a cabinet having a rear wall with bus bars attached thereto, a first sidewall, and a front wall having a jamb receiving a door and defining a front wall opening, the door opening outwardly from the cabinet;

a switch assembly having a longitudinal axis, a plurality of switch contacts and a control shaft for controlling the position of the switch contacts, and being connected to the first sidewall with the longitudinal axis oriented generally parallel to the sidewall and generally perpendicular to the rear wall and front wall, the switch assembly being operable between an open and a closed position, the control shaft having an axis of rotation which is parallel to the longitudinal axis; and an operating handle fixed to the control shaft for operating the swtich assembly between the open and the closed positions, the operating handle being located outside of the cabinet such that the operating handle interferes with the opening of the door when the switch is in the closed position and does not interfere with the door when the switch is in the open position.

2. A load break switch and interlock assembly according to claim 1, wherein the switch assembly is connected to the bus bars by jumpers.

* * * * *